US005738192A

United States Patent [19]

Miner

[11] Patent Number: 5,738,192

[45] Date of Patent: Apr. 14, 1998

[54] POWER TOOL DRIVES

[76] Inventor: Montie H. Miner, 2205 Robert, Granite City, Ill. 62040

[21] Appl. No.: 715,439

[22] Filed: Sep. 18, 1996

[51] Int. Cl.[6] ..... B25B 13/46

[52] U.S. Cl. ..... 192/43.1; 81/57.39; 81/63; 81/63.2; 74/577 M

[58] Field of Search ..... 192/43.1, 46; 74/575, 74/577 M; 81/57.39, 63.2, 63

[56] References Cited

U.S. PATENT DOCUMENTS

| | | | |
|---|---|---|---|
| 581,427 | 4/1897 | Olson | 192/43.1 X |
| 2,020,883 | 11/1935 | Gagne | 192/43.1 |
| 2,107,568 | 2/1938 | Haist | 192/43.1 X |
| 2,143,121 | 1/1939 | Cox | 192/43.1 |
| 2,407,558 | 9/1946 | Kress | 192/43.1 |
| 2,744,432 | 5/1956 | Rueb | 192/43.1 X |
| 2,773,574 | 12/1956 | Able | 192/43.1 |
| 4,520,697 | 6/1985 | Moetteli | 81/62 |
| 4,722,253 | 2/1988 | Chow | 81/63 |
| 4,977,795 | 12/1990 | McVey | 74/575 |
| 5,000,066 | 3/1991 | Gentiluomo | 81/62 |
| 5,058,463 | 10/1991 | Waunop | 81/57.29 |
| 5,174,176 | 12/1992 | Krivec | 81/63.1 |
| 5,269,195 | 12/1993 | Kitagawara | 74/577 M X |
| 5,328,241 | 7/1994 | Haider | 74/577 M X |
| 5,392,672 | 2/1995 | Larson et al. | 81/60 |
| 5,450,773 | 9/1995 | Darrah et al. | 81/57.39 |

*Primary Examiner*—Andrea L. Pitts

[57] ABSTRACT

A power tool is provided with a yoke having first and second chambers each of which open into said bore; an annular toothed gear is rotatably disposed in said bore, each gear tooth being rounded at its outer extremity and each gap between adjacent teeth being rounded in such manner that the outwardly presented angle of each gap is greater than the inwardly presented angle of each tooth; one pawl comprising a cylindrical element and a wing is pivotally disposed in each chamber, each wing having a first pawl tooth sized for snug fitting disposition between adjacent gear teeth and a second pawl tooth which is sized and shaped for using an adjacent gear tooth to urge the first pawl tooth snugly into a gap on the gear as the first pawl is pivoted toward the gear; a biasing member in each chamber which urges the wing towards the gear, and a direction control which selectively allows only one of the two pawls to engage the gear as the yoke is moved with respect to the gear.

7 Claims, 4 Drawing Sheets

POWER TOOL DRIVES

This invention relates to power tools.

Applicant is the coinventor of a power tool for which U.S. Pat. No. 5,450,773 issued on Sep. 19, 1995, and which employs a high-speed motor to drive a yoke which in turn drives a rotatable gear through biased pawls mounted in the yoke. Applicant has developed and achieved a reversible yoke, pawl and gear combination which is so designed and constructed that maximum power and torque are transferred from the yoke to the gear, and wear on the pawl and gear teeth is minimized, thereby yielding a reversible power tool which is efficient, and has a substantially longer use life. It is the object of this invention to provide a yoke, gear and pawl combination which is durable, efficient, powerful, longer lasting, and usable on all power tools.

IN THE DRAWINGS

DESCRIPTION

Figure 1:
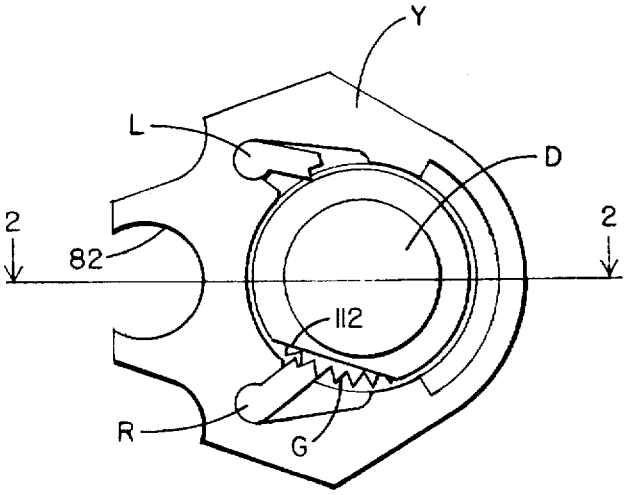
FIG. 1 is a top view of a preferred embodiment of my invention.
Figure 2:
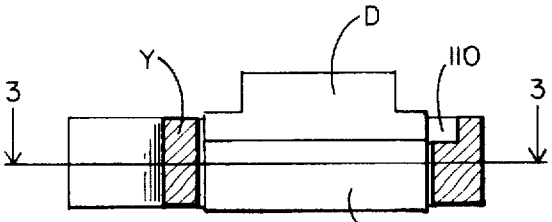
FIG. 2 is a sectional view taken along lines 2—2 of FIG. 1.
Figure 4:
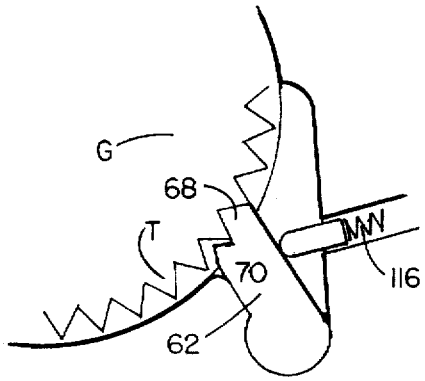
FIG. 4 is an enlarged view of the right pawl in the yoke as shown in FIG. 3.
Figure 5:
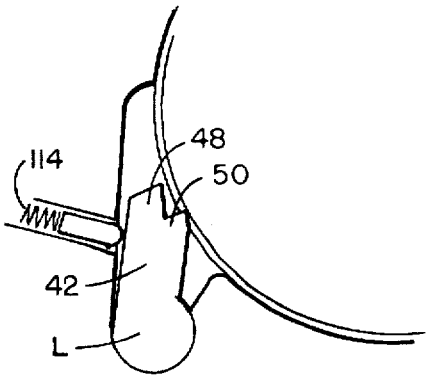
FIG. 5 is an enlarged view of the left pawl in the yoke as shown in FIG. 3.
Figure 3:
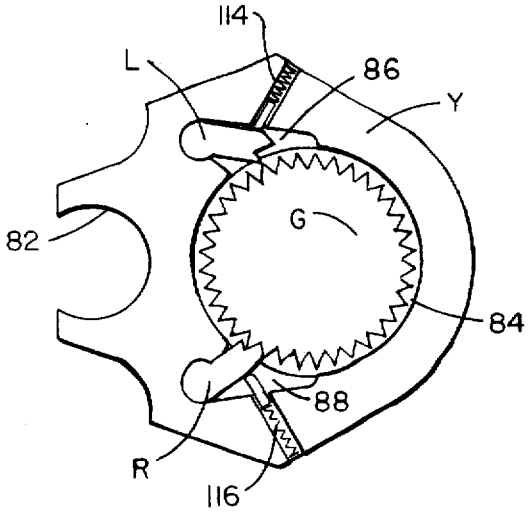
FIG. 3 is a sectional view taken along lines 3—3 of FIG. 2.

Referring now in more detail, and by reference character to the drawings which illustrate a preferred embodiment of our invention, Y designates a yoke in which a gear G is rotatably disposed and complementary pawls L and R are pivotally disposed, L representing the pawl on the left and R representing the pawl on the right.

Figure 6:
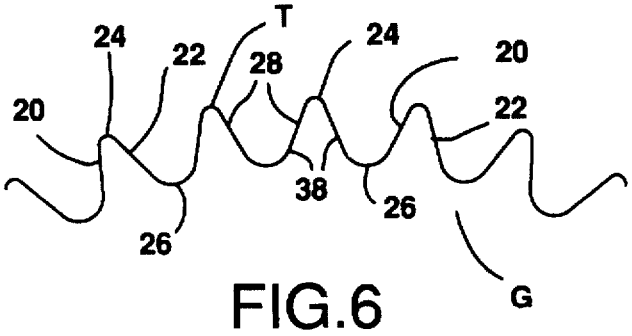
FIG. 6 is an enlarged view of several gear teeth T.
Figure 7:
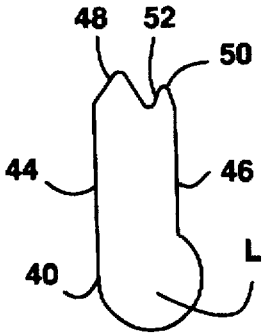
FIG. 7 is an enlarged end view of left pawl L.
Figure 8:
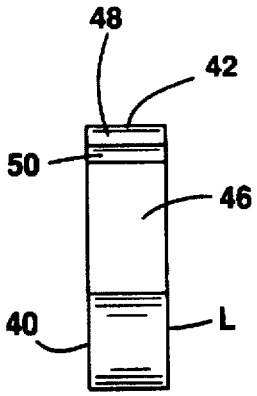
FIG. 8 is a side view of FIG. 7.
Figure 9:
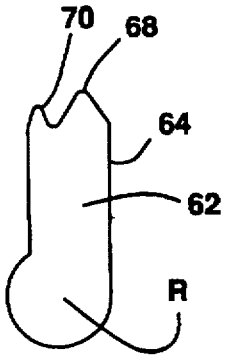
FIG. 9 is an enlarged end view of right pawl R.
Figure 10:
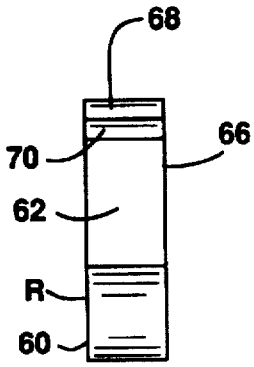
FIG. 10 is a side view of FIG. 9.
Figure 11:
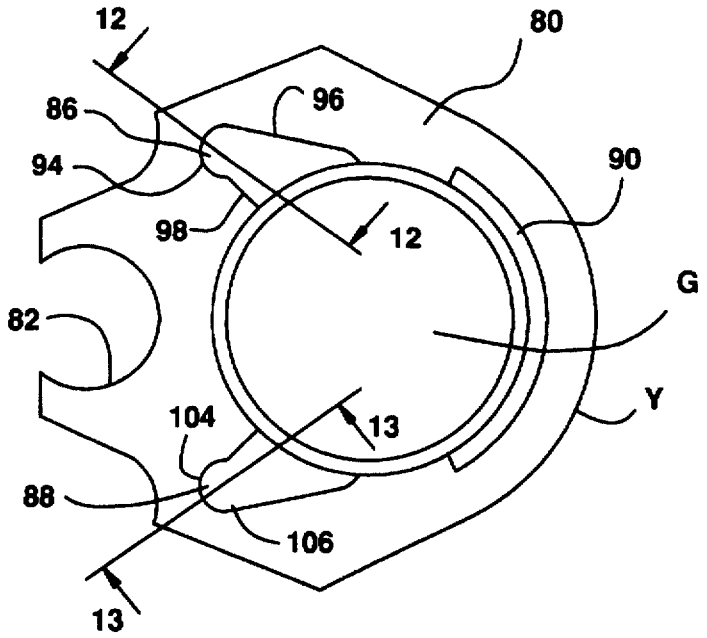
FIG. 11 is a top view of my yoke Y.
Figure 12:
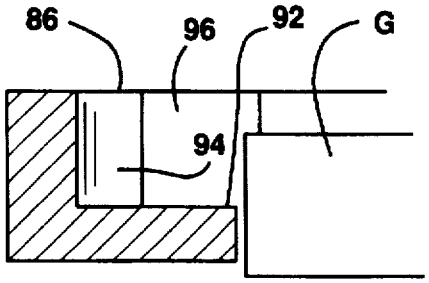
FIG. 12 is a sectional view taken along lines 12—12 of FIG. 11.
Figure 13:
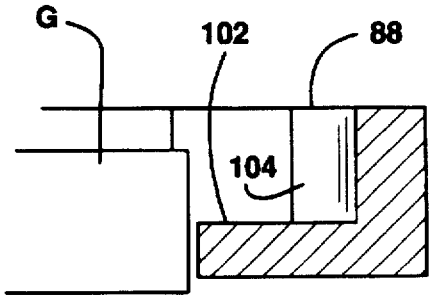
FIG. 13 is a sectional view taken along lines 13—13 of FIG. 11.

The gear G comprises a plurality of outwardly presented teeth T, each equally spaced from its adjacent teeth about the entire periphery of the gear G. Each tooth T includes flat faces 20, 22, a rounded tip 24 at its outer extremity, and a rounded valley 26 where adjacent teeth T intersect. The radius defining the rounded tip 24 is substantially smaller than the radius defining the rounded valley 26 whereby the open angle 28 between the adjacent teeth T, T', is substantially larger than the angle 38 between the faces 20, 22, as can best be seen in FIG. 6, all for purposes presently more fully to appear.

The left pawl L comprises an elongated rod 40 provided with an outwardly extending wing 42. The rod 40 is cylindrical except where the wing 42 projects outwardly therefrom. The wing 42 has an outer face 44 which is flat and tangential to the cylindrical surface of the rod 40 and an inner face 46 which intersects the cylindrical surface of the rod 40. A pair of differently sized teeth 48, 50, are provided at the outer end of the wing 42, the tooth 48 being sized for snug fitting disposition between faces 22, 20' of adjacent teeth T, T', of the gear G, and the tooth 50 being sized smaller in width and length than the tooth 48, and also including a flat face 52 which is sized and located for flushwise disposition against face 20 of the tooth T when the tooth 48 is snugly disposed between adjacent gear teeth T, T'.

Similarly, the right pawl R comprises an elongated rod 60 provided with an outwardly extending wing 62. The rod 60 is cylindrical except where the wing 62 projects outwardly therefrom. The wing 62 has an outer face 64 which is flat and tangential to the cylindrical surface of the rod 60 and an inner face 66 which intersects the cylindrical surface of the rod 60. A pair of differently sized teeth 68, 70, are provided at the outer end of the wing 62, the tooth 68 being sized for snug fitting disposition between faces 22, 20' of adjacent teeth T, T', of the gear G, and the tooth 70 being sized smaller in width and length than the tooth 68, and also including a flat face 72 which is sized and located for flushwise disposition against face 20' of the tooth T' when the tooth 68 is snugly disposed between gear teeth T, T'.

The yoke Y comprises a solid member 80 provided at one end with a crank receiving recess 82 sized for receiving a conventional driving crank (not shown) and at the other end with a bore 84 sized for having the gear G rotatably disposed therein. The member 80 is also provided with a left chamber 86 and a right chamber 88, each being accessible from the top and sized for receiving left pawl L and right pawl R respectively. The chambers 86, 88, each open into the bore 84 whereby the pawls L and R may each engage the gear G from their respective chambers. Provided along the top of the yoke Y is a recessed annular shoulder 90.

The left chamber 86 has a flat base 92, an arcuate wall 94 sized for retaining in close fitting disposition the cylindrical rod 40 as the pawl L is pivoted, an outer wall 96 which tangentially intersects the arcuate wall 94, and a flat inner wall 98 which also intersects the arcuate wall 94. It should be here noted that the angle at the junction between the inner wall 98 and the cylindrical wall 94 equals the angle at the intersection of the cylindrical rod 40 and the inner face 46 of the left pawl L, such that when the pawl L is seated in the chamber 86 and pivoted fully inwardly, the inner face 46 of the pawl L is in flushwise engagement with the inner wall 98 of the chamber 86 and arcuate wall 94 of the chamber 86 is in flushwise engagement with a substantial portion of the cylindrical rod 40, all for purposes soon to appear.

Similarly, the right chamber 88 has a flat base 102, an arcuate wall 104 sized for retaining in close fitting disposition the cylindrical rod 60 as the pawl R is pivoted, an outer wall 106 which tangentially intersects the arcuate wall 104, and a flat inner wall 108 which also intersects the arcuate wall 104. It should be here noted that the angle of the junction between the inner wall 108 and the cylindrical wall 104 equals the angle at the intersection of the cylindrical rod 60 and the inner face 66 of the right pawl R, such that when the pawl R is seated in the chamber 88 and pivoted fully inwardly, the inner face 66 of the pawl R is in flushwise engagement with the inner wall of the chamber 88 and arcuate wall 104 of the chamber 88 is in flushwise engagement with a substantial portion of the cylindrical rod 60, all for purposes soon to appear.

The pawls L and R are lengthwise sized so that each will extend from the base of their respective chambers 86, 88, into the recess 90 and to the top of the yoke Y. The gear G is sized so that its upper surface is co-planar with the shoulder 90. A selectively positionable directional control D (partially shown) including an arcuate shoulder 110 with a flat segment 112 is positioned in the recess 90 in such manner that no two pawls engage the gear G at the same time, but only one of the pawls L, R, may engage the gear teeth T at any given time when the segment 112 spans its respective chamber 86, 88. A biasing spring 114 mounted on the left side of the yoke Y and extending into the chamber 86 urges the left pawl L to pivot in the chamber 86 toward the inner wall 98. A second biasing spring 116 mounted on the right side of the yoke Y and extending into the chamber 106 urges the right pawl R to pivot in the chamber 86 toward the inner wall 108.

OPERATION

Figure 14:
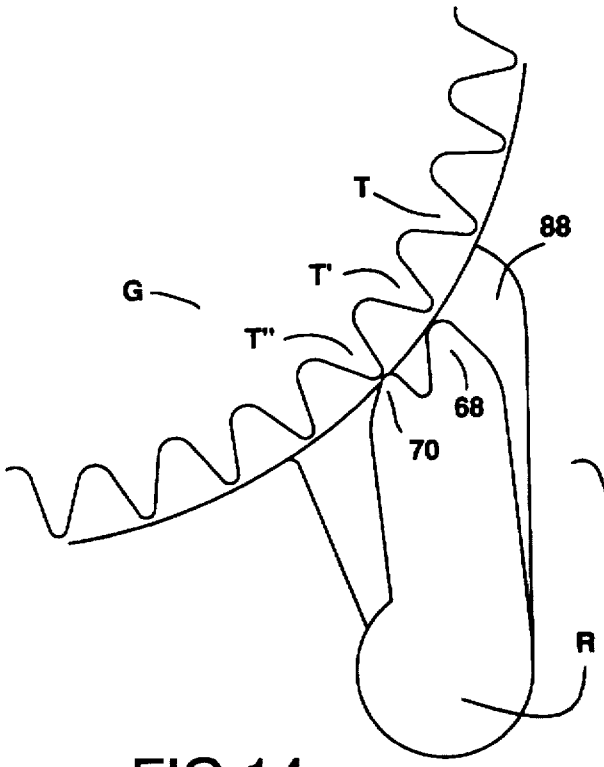
FIG. 14 shows the relative positions of the yoke, gear and right pawl during the start of powered movement.
Figure 15:
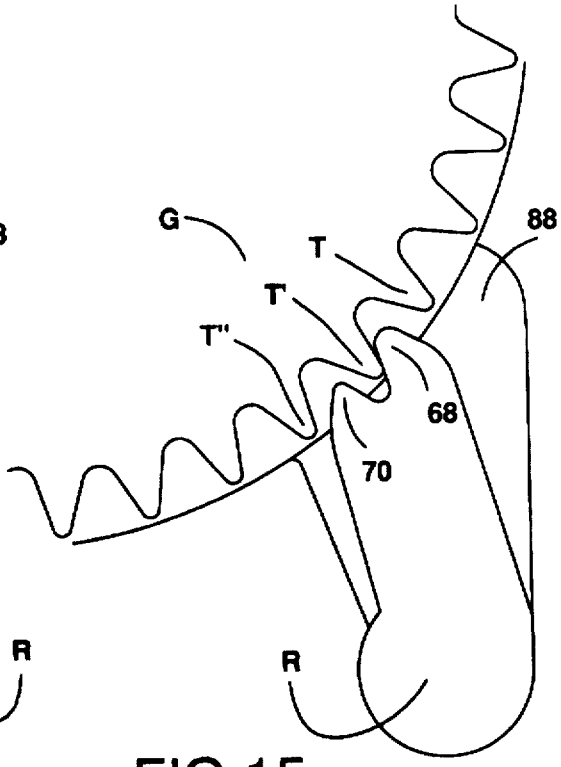
FIG. 15 shows the relative positions of the yoke, gear and right pawl as engagement commences.
Figure 16:
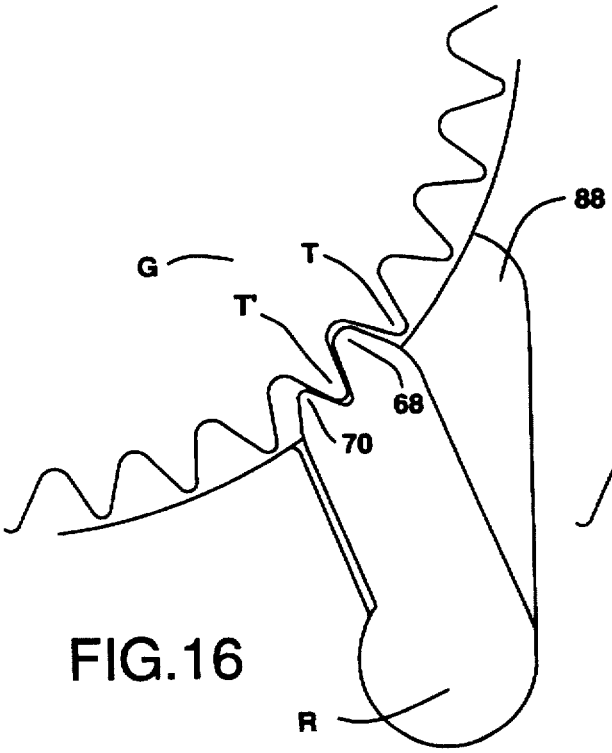
FIG. 16 shows the relative positions of the yoke, gear and right pawl as the pawl is about to seat itself between adjacent gear teeth.
Figure 17:
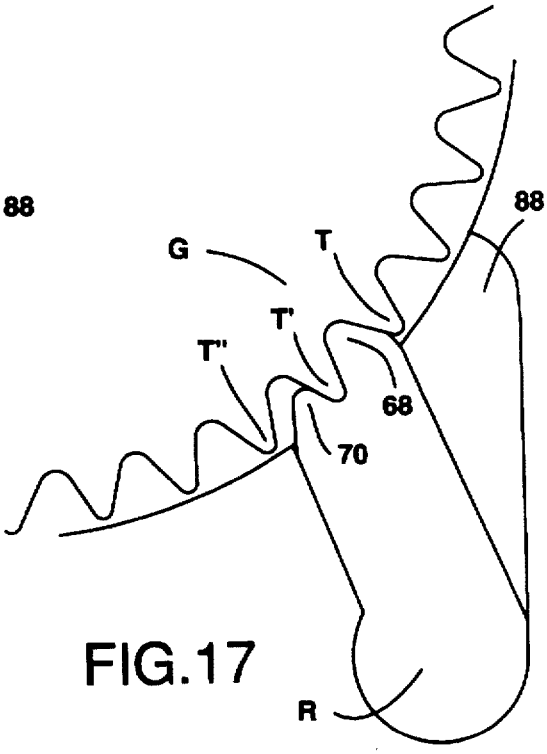
FIG. 17 shows the relative positions of the yoke, gear and right pawl when the pawl is fully seated and rotational drive power is applied.

In use, the yoke Y, gear G, pawls L, R, and directional control D are operatively mounted on a power tool in a manner similar to that shown in U.S. Pat. No. 5,450,773. To illustrate, the directional control D is positioned in the recess in such manner that the right pawl R is exposed to the gear teeth T and the left pawl L is held back against the outer wall 94 of the chamber 86 and away from the gear teeth T by the shoulder 110. Referring now to FIGS. 14 through 17 inclusive, the operational position of the pawl R and the teeth T, T', is shown as the right pawl R is pivoted toward the inner wall 108 during the powered stoke of the yoke Y. Referring to FIG. 14, we see the yoke Y being moved in a counterclockwise direction, and the tooth 70 sliding over the end of the gear tooth T" as it is moved toward the tooth T'. The shorter length and rounded edge of the tooth 70 allow it to slide without interference around the tooth T". Referring to FIG. 15, as the tooth 70 of pawl P slides along the edge of the tooth T", tooth 70 urges the tooth T' toward its desired position between the teeth 68, 70. Referring now to FIG. 16, the teeth 68, 70, are contacting teeth T", T', respectively, and the tooth 68 is positioned for seating itself snugly in the space between adjacent gear teeth T', T, as the powered stroke proceeds. Referring now to the final FIG. 17, the pawl R is properly seated between adjacent teeth T', T, in which position both faces of the tooth 68 are in flushwise engagement with the gear teeth T, T', and the face of the tooth 70 is in flushwise engagement with the tooth T', in which seated position the teeth 68, 70 remain for most of the powered stroke. Once pawl R is seated, the power stroke continues and there is no movement between the faces of the gear teeth and pawl teeth. No movement equates to no wear under most of the load. Since there is little load while the pawl teeth are being positioned, the life cycle of the tool is increased by at least a factor of four.

The unique and novel structure of the pawl teeth 68, 70, also eliminate jamming and interference on the return stroke of the yoke Y as shown sequentially in FIGS. 17, 16, 15 and 14. As the yoke return stroke progresses, the face of the larger pawl tooth 68 which is seated against the face 20 of the tooth T slides upwardly along the tooth T and is caused to be pivoted away from the tooth T by the outer end 24 of the tooth T until the pawl R is pivoted fully away from the tooth T, and the only part of the pawl R which contacts the teeth T of the gear G is the pawl tooth 70. There is no sliding contact under load on the driving face of the tooth 68 because that force is not applied until the tooth 68 is seated between adjacent gear teeth. No contact under load means minimum wear.

A second benefit relates to torque efficiency. There is solid contact between the yoke Y and the cylindrical portions of the pawls R, L, and simultaneously there is direct contact between the teeth of the pawls R, L, and the gear teeth T, T' during the power stroke, wherein the gear G being driven is snugly backloaded against the yoke Y. The cranking power applied to the yoke is thereby transferred directly to the gear G because of the aforementioned backloading. This feature is a substantial improvement over the present state of the art where spring biased devices reduce the torque that should be applied to the work.

A third distinguishing feature over the present art is the stability provided by the unique and novel construction of the chambers 86, 88, and their respective pawls L, R. The arcuate wall 94 of the chamber 86 is sized to accept in close fitting but pivotal relationship the cylindrical rod 40 of the pawl L. Similarly, the arcuate wall 104 of the chamber 88 is sized to accept in close fitting but pivotally movable relationship the cylindrical rod 60 of the pawl R. The aforementioned interrelationships greatly reduce and in almost all cases reduce the wobble usually encountered as pneumatic tools are powered up to high speeds. If the speeds encountered are such that wobble might be a concern, that wobble can be eliminated by appropriate bores in the pawls L, R, and posts in the chambers 86, 88, without departing from the nature and principle of my invention.

Applicant points out that the unique and novel construction of the pawl and gear in which the angle between opposing faces of the same gear tooth is less than the angle between adjacent gear teeth, and in which the pawl tooth which first comes into contact with the gear is shorter and narrower than the other pawl tooth which becomes snugly seated between gear teeth, is a major part of this invention and produces the previously described benefits.

It should be noted that changes and modifications to the various parts, components, structures and combinations shown herein made be made and substituted without departing from the nature and principle of my invention.

Having thus described my invention, what I claim and desire to secure by letters patent is shown in the drawings, described in the specification and recited in the following claims.

I claim:

1. A tool comprising a yoke provided with an annular bore and first and second spaced chambers each of which open into said bore, an annular gear rotatably disposed in said bore and being provided along its outer periphery with a plurality of teeth, each tooth being rounded at its outer extremity and each gap between adjacent teeth being rounded in such manner that the outwardly presented angle of each gap is greater than the inwardly presented angle of each tooth, a first pawl pivotally disposed in said first chamber and including a first pawl tooth sized for snug fitting disposition in any of the gaps on the gear, said first pawl also including a second pawl tooth which is sized and shaped for cooperating with an adjacent gear tooth to urge the first pawl tooth snugly into a gap on the gear as the first pawl is pivoted toward the gear, a second pawl pivotally disposed in said second chamber and including a third pawl tooth sized for snug fitting disposition in any of the gaps on the gear, said second pawl also including a fourth pawl tooth which is sized and shaped for cooperating with an adjacent gear tooth to urge the third pawl snugly into a gap on the gear as the second pawl is pivoted toward the gear, first biasing means in the first chamber for urging the first pawl towards the gear, and second biasing means in the second chamber for urging the second pawl towards the gear, and control means for selectively allowing only one of the two pawls to engage the gear as the yoke is moved with respect to the gear.

2. The combination of claim 1 in which the first chamber is provided with a first concave arcuate wall, the second chamber is provided with a second concave arcuate wall, the first pawl is provided with a first convex arcuate wall, the second pawl is provided with a second convex arcuate wall, the concave arcuate walls have substantially the same radius as the convex arcuate walls, the first pawl is sized and located such that when the first tooth is seated in a gap between adjacent gear teeth the first concave wall and the first convex wall will be in direct contact with each other, and the second pawl is sized and located such that when the third tooth is seated in a gap between adjacent gear teeth the second concave wall and the second convex wall will be in direct contact with each other, whereby the driving force applied to the yoke will be fully transferred to the gear.

3. The tool of claim 1 in which the second pawl tooth is sized substantially shorter and substantially narrower at its base than the first pawl tooth, and the fourth pawl tooth is sized substantially shorter and substantially narrower at its base than the third pawl tooth.

4. In a power tool, the combination of a yoke and pawl, said yoke comprising a reciprocally driven member provided with an enlarged bore and a chamber, said chamber being substantially cylindrical in shape and including an axially extending opening leading to a larger chamber, said pawl including an elongated element which is cylindrical over most of its periphery and sized for snug but pivotal disposition in the smaller chamber of the yoke, said pawl also including an outwardly projecting element which extends through the larger chamber into the bore through said opening, the periphery of the chamber being substantially greater than semicylindrical in cross-section whereby to retain the pawl therewithin during pivotal movement solely by its shape.

5. The combination of claim 4 in which the smaller and larger sections of the chamber of the yoke are provided with a common flat floor, one end of the pawl is also flat, the cylindrical wall of the smaller section of the chamber of the yoke is sized for retaining the pawl in the smaller section of the chamber during pivotal movement when the flat end of the pawl is on the flat floor of the chamber, and the outwardly projecting element is provided with a plurality of different sized teeth which are moved into and out of the bore as the pawl is pivoted.

6. In a power tool comprising a reciprocally moving yoke and a movable gear having a plurality of spaced teeth about its periphery, the improvement of a pawl pivotally disposed in a chamber within the yoke, means for selectively engaging the pawl with the gear teeth as the yoke is moved in a preselected direction, and backloading means for transferring substantially all of the moving power from the yoke to the gear as the yoke is moved in said direction, said backloading means including a first cylindrical wall within the chamber, a second cylindrical wall on the pawl, said first cylindrical wall being slightly larger diametrically than said second cylindrical wall, said pawl being disposed within said chamber in such manner that the cylindrical walls are coaxial, retaining means for placing the first and second cylindrical walls in firm contact with each other as the yoke is moved in said preselected direction, and support means for moving the pawl and yoke together as a single unit as power is applied to the gear from the yoke.

7. The device of claim 6 in which the retaining means includes a first flat surface on the yoke which extends from the first cylindrical wall surface toward the gear, and a second flat surface on the pawl which is sized and located on the pawl in such manner that said second flat surface may be pressed against said first flat surface when the pawl is pivoted fully inwardly, and biasing means for urging the second flat surface against the first flat surface when the yoke moves in the preselected direction.

* * * * *